US005827106A

United States Patent [19]

Crepeau et al.

[11] Patent Number: 5,827,106

[45] Date of Patent: Oct. 27, 1998

[54] TOY CONSTRUCTION PIECE AND KIT THEREOF

[75] Inventors: Jean-Philippe Crepeau, Montreal; Jean-Christophe Doyon, Verdun; Christian Lemire, Montreal; Réal Lanoix, Laval, all of Canada

[73] Assignee: Ritvik Holdings Inc., Quebec, Canada

[21] Appl. No.: 787,568

[22] Filed: Jan. 22, 1997

[51] Int. Cl.[6] ..... A63H 33/08

[52] U.S. Cl. ..... 446/128; 446/102; 446/85

[58] Field of Search ..... 446/85, 93, 128, 446/102

[56] References Cited

U.S. PATENT DOCUMENTS

| | | | |
|---|---|---|---|
| 4,270,303 | 6/1981 | Xanthopoulos et al. | 446/128 |
| 4,872,410 | 10/1989 | Lilly | 446/128 |
| 5,015,210 | 5/1991 | Dideriksen | 446/128 |

OTHER PUBLICATIONS

Excerpts from Lego Catalog, dated 1978.

*Primary Examiner*—Robert A. Hafer
*Assistant Examiner*—Jeffrey D. Carlson
*Attorney, Agent, or Firm*—Michael D. Bednarek; Kilpatrick Stockton LLP

[57] ABSTRACT

Disclosed is a toy construction piece being in the form of a half-shell having a bottom portion, a top portion, a bottom wall portion and first and second pair of top wall portions. The bottom wall portion is generally octagonal in shape. The first and second pair of top wall portions extend perpendicularly to each other from the bottom wall portion to the top portion, forming together a generally pyramidal shape and defining four generally dihedral recesses between the four adjacent top wall portions respectively. Each of the dihedral recesses have a bottom in the form of a flat surface. Each of the flat surfaces have rows of outwardly projecting pegs and have an opening also having outwardly projecting pegs. The top portion has a border having two rows of outwardly projecting pegs, the inner row being downwardly recessed from the other. The border defines an opening therein and has an inner surface having outwardly projecting pegs. The bottom of the toy construction piece has openings cooperating with the pegs of a standard block for releasably interlocking the standard block on the bottom of the toy construction piece. The toy construction may be used to construct elaborate structures. The toy construction piece disclosed may also be a part of a kit for assembling more elaborate structures. To that effect, the kit may include standard toy construction blocks, a hinge for interconnecting two identical toy construction pieces, a support member, a leg and a foot, a turret, a cockpit and a cockpit hinge and a triangular piece.

36 Claims, 12 Drawing Sheets

TOY CONSTRUCTION PIECE AND KIT THEREOF

FIELD OF THE INVENTION

The invention concerns a toy construction piece and a kit including toy construction blocks and at least one of the toy construction pieces so disclosed.

DESCRIPTION OF THE PRIOR ART

Toy construction blocks are well known in the art and come in various sizes and shapes. They are usually rectangular in shape and have upwardly projecting pegs on their top surface arranged in a matrix, and means on their bottom surface for releasably interlocking one of these blocks on top of another toy construction block. Using a plurality of these blocks, one may assemble various structures, such as houses, cars, airplanes, to name but a few examples. These blocks are extremely versatile given the variety of the shapes available and their easy interlocking mechanism.

One of these standard toy construction blocks is shown on FIG. 15. This standard block that is numbered 1, has a given width and a given length, a top on which extends at least one row of at least one upwardly projecting peg 5 having a center, and a bottom provided with means cooperating with at least one peg 5 of another standard block for releasably interlocking the standard block on top of another standard block. The standard block 1 is based on a system where the width w of the standard block is an integer multiple of a distance d and the length L is another integer multiple of the distance d. The upwardly projecting peg 5 is centered within a square of length d such that when the standard block 1 has, as is shown, more than one row of more than one peg 5, the longitudinal and transverse distance between the centers of each pair of adjacent pegs is equal to d. These blocks are available in different sizes which are identified by the number of rows of pegs and the number of pegs in a row: for example, the 2 by 4 block of FIG. 15 has two rows of four pegs on its top surface.

Toy construction blocks have a standard height $H_S$. Base plates according to the same system have a height which is equal to one half or one third the standard height. However, standard toy construction blocks are ill-adapted to build futuristic structures evoquing space travel and exploration, planets, or other life forms. To Applicant's knowledge, dome-shaped toy construction pieces have not been disclosed, neither has a system for interconnecting two such pieces to form various structures.

SUMMARY OF THE INVENTION

It is an object of the invention to provide a toy construction piece which is shaped and sized so as to build more elaborate structures.

In accordance with the invention, this object is achieved with a toy construction piece being in the form of a half-shell with an inside surface and an outside surface. The toy construction piece comprises a bottom portion, a top portion, a bottom wall portion, a first and second pair of top wall portions and flat surfaces.

The bottom portion lies in a plane P, has a periphery and includes a bottom portion edge. The bottom portion edge has a first and second pair of parallel sides of length L1 and L2, respectively, the first pair of parallel sides being perpendicular to the second pair of parallel sides. The bottom portion is provided with means cooperating with the pegs of the standard blocks for releasably interlocking one or more of the standard blocks on the bottom portion of the toy construction piece.

The top portion has a border, four corners and a rectangular opening therein, and lies in a plane parallel to the plane P at a perpendicular distance D from the plane P. The border has a third and fourth pairs of parallel sides of length L3 and L4, respectively, the third pair of parallel sides being parallel to the first pair of parallel sides while the fourth pair of parallel sides is parallel to the second pair of parallel sides. The border has a top surface and an inner surface, the border of the top portion being provided with at least one row of outwardly projecting pegs identical to those of the toy construction blocks, the longitudinal distance between every a pair of pegs of the border being equal to d, and the border including a peg at each corner.

The bottom wall portion extends along the periphery of the bottom portion and towards the top portion. The bottom wall portion has a width W smaller than the distance D and has a fifth and sixth pairs of parallel sides of length L5 and L6, respectively, the fifth pair of parallel sides being parallel to the first and third pairs of parallel sides while the sixth pair of parallel sides is parallel to the second and fourth pairs of parallel sides.

The toy construction piece also has first and second pairs of top wall portions, where the first pair of top wall portions has one top wall portion extending from one side of the fifth pair of parallel sides to the corresponding side of the third pair of parallel sides, the first pair of top wall portions also having another top wall portion extending from the other side of the fifth pair of parallel sides to the corresponding side of the third pair of parallel sides, and where the second pair of top wall portions has one top portion extending from one side of the sixth pair of parallel sides to the corresponding side of the fourth pair of parallel sides, the second pair of top wall portions also having another top wall portion extending from the other side of the sixth pair of parallel sides to the corresponding side of the fourth pair of parallel sides. The first and second pairs of top wall portions form together a generally rectangular pyramidal shape and define four generally dihedral recesses between the four adjacent top wall portions respectively, each of the dihedral recesses having a top bounded by the top portion and a bottom in the form of a flat surface lying in a plane parallel to the plane P at a distance w from the plane P, the flat surface extending perpendicularly inwardly from the bottom wall portion and having edges and an inside surface.

The flat surfaces are each provided with at least one row of at least one outwardly projecting peg identical to those of the toy construction blocks, the longitudinal distance between adjacent pegs of the row being equal to d, the transverse distance between adjacent pegs being equal to d and the distance between every peg adjacent to one of the edges and the edge being equal at least to ½d.

It is a further object of the invention to provide a kit for assembling more elaborate structures.

In accordance with the invention, the kit comprises (a) toy construction blocks and (b) at least one toy construction piece as defined above. The kit may also include (c) means for interconnecting two identical toy construction pieces, including a hinge member; (d) a plate adapted in size and shape to be inserted into the inside surface of the toy construction piece; (e) a support member, being generally U-shaped and adapted to be inserted into the opening of the top portion of the toy construction piece; (f) a leg adapted to be inserted into one of the openings of the flat surfaces; (g) a foot adapted to be releasably fastened to one of the ends of the leg; (h) a turret, permitting rotational movement of toy construction blocks releasably interlocked on its top surface; (i) a cockpit adapted to be releasably interlocked on the hinge member; (j) a cockpit hinge to permit the cockpit to be opened and closed; and/or (k) a triangular piece used for releasably interlocking standard toy construction blocks at an angle.

BRIEF DESCRIPTION OF THE DRAWINGS

The present invention and its advantages will be more easily understood after reading the following non-restrictive description of preferred embodiments thereof, made with reference to the following drawings, where like numerals refer to like elements and.

DESCRIPTION OF A PREFERRED EMBODIMENT OF THE INVENTION

Figure 15:
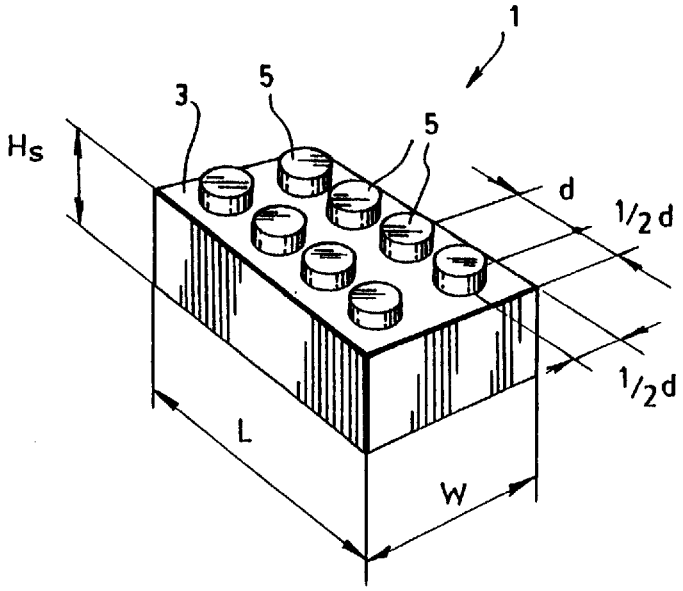
FIG. 15 ( PRIOR ART )
FIG. 15 identified as prior art is a perspective view of a standard toy construction block.

As the pegs of all of the elements of the present invention are identical to the pegs of a standard toy construction block 1, shown on FIG. 15, all of the pegs will be identified as numeral 5.

Figure 1:
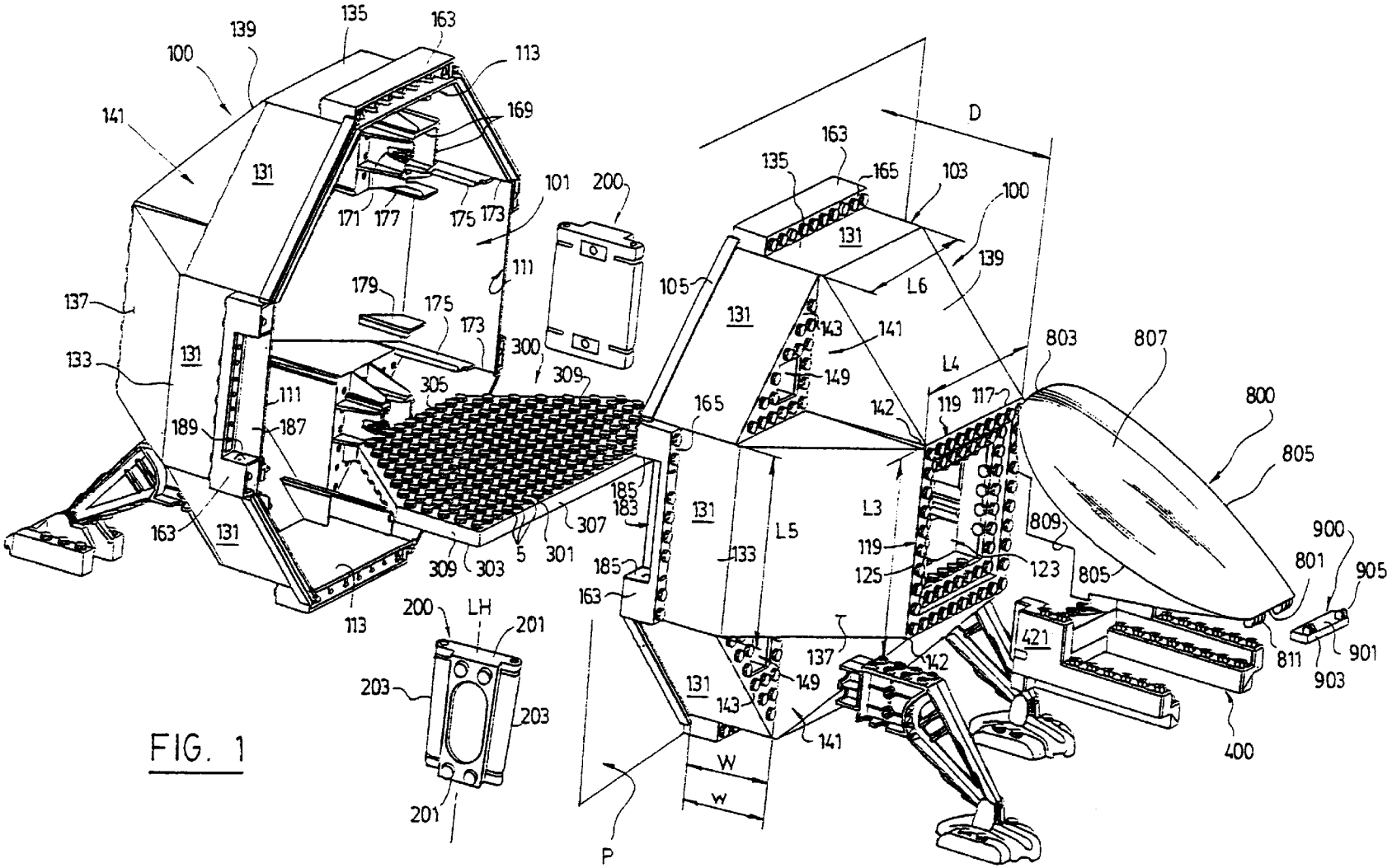
FIG. 1 is an exploded perspective view of a preferred embodiment of a kit according to the invention.

FIG. 1 is an exploded view of a kit according to a preferred embodiment of the invention. The main components of this kit are one or two toy construction pieces 100 on which a number of other elements may be releasably interlocked to build a toy. For illustration purposes only, the assembled kit shown in FIG. 1 includes two toy construction pieces 100, two hinges 200, a plate 300, two legs 500, two feet 600, a support member 400, a cockpit 800 and a cockpit hinge 900 and one standard toy construction block 1. Each of these elements will be hereinafter separately described, except for the standard toy construction blocks referred to in the Background of prior art. As such, a kit according to the invention will include (a) a plurality of standard toy construction blocks 1 and (b) at least one toy construction piece 100.

(b) Toy construction piece

The main element of the kit according to the invention, which element is hereinafter claimed per se, is the toy constriction piece 100. It is in the form of a half-shell with an inside surface 101 and an outside surface 103. The toy construction piece 100 comprises a bottom portion 105, a top portion 117, a bottom wall portion 131, a first 137 and second 139 pair of top wall portions and flat surfaces 143.

The bottom portion 105 lies in a plane P, has a periphery and includes a bottom portion edge 109. The bottom portion edge 109 has a first 111 and second 113 pair of parallel sides of length L1 and L2, respectively, the first pair 111 of parallel sides being perpendicular to the second pair 113 of parallel sides. Preferably, the first 111 and second 113 pair of parallel sides of the bottom portion 105 are centered about a common axis perpendicular to the plane P.

The bottom portion 105 is provided with means 115 cooperating with the pegs of the standard blocks 1 for releasably interlocking one or more of the standard blocks 1 on the bottom portion 103 of the toy construction piece 100.

Figure 3:
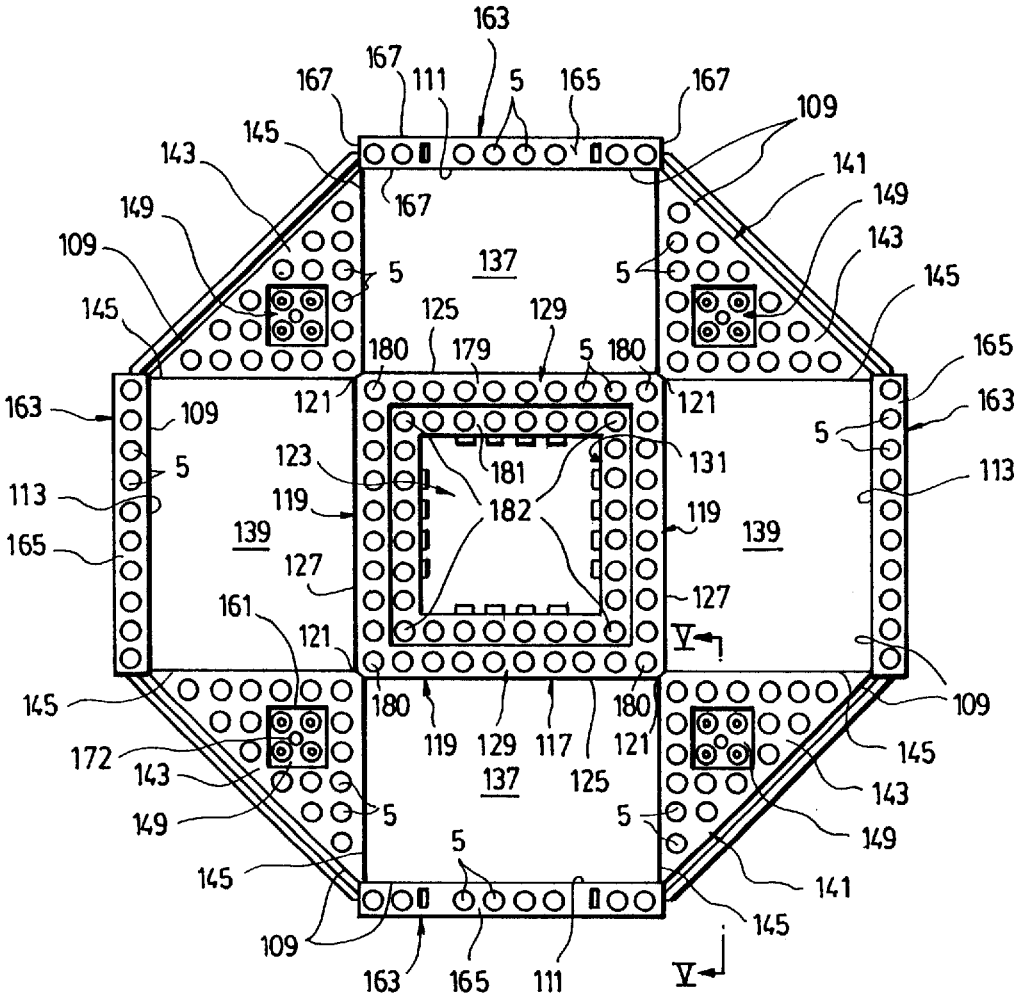
FIG. 3 is a top plan view of the toy construction piece of the kit according to the preferred embodiment of the invention.

Preferably also, the first 111 and second 113 pairs of parallel sides are each provided with an extension 163 on the outside surface 103, each of the extensions 163 having a top surface 165 lying in a plane parallel to the plane P. As is better shown in FIG. 3, the top surface 165 of each extension has edges 167 and is provided with at least one row of outwardly projecting pegs 5 identical to those of the toy construction blocks 1, the longitudinal distance between one peg 5 and an adjacent peg 5 of the row being equal to d or a multiple of d, the transverse distance between one peg 5 and an adjacent peg 5 being equal to d and the distance between every peg 5 adjacent to one of the edges 161 and the edge 161 being equal to at least ½d. Preferably, each of the extensions 163 has a length equal to tell times d and equal to L1 and L2.

Figure 4:
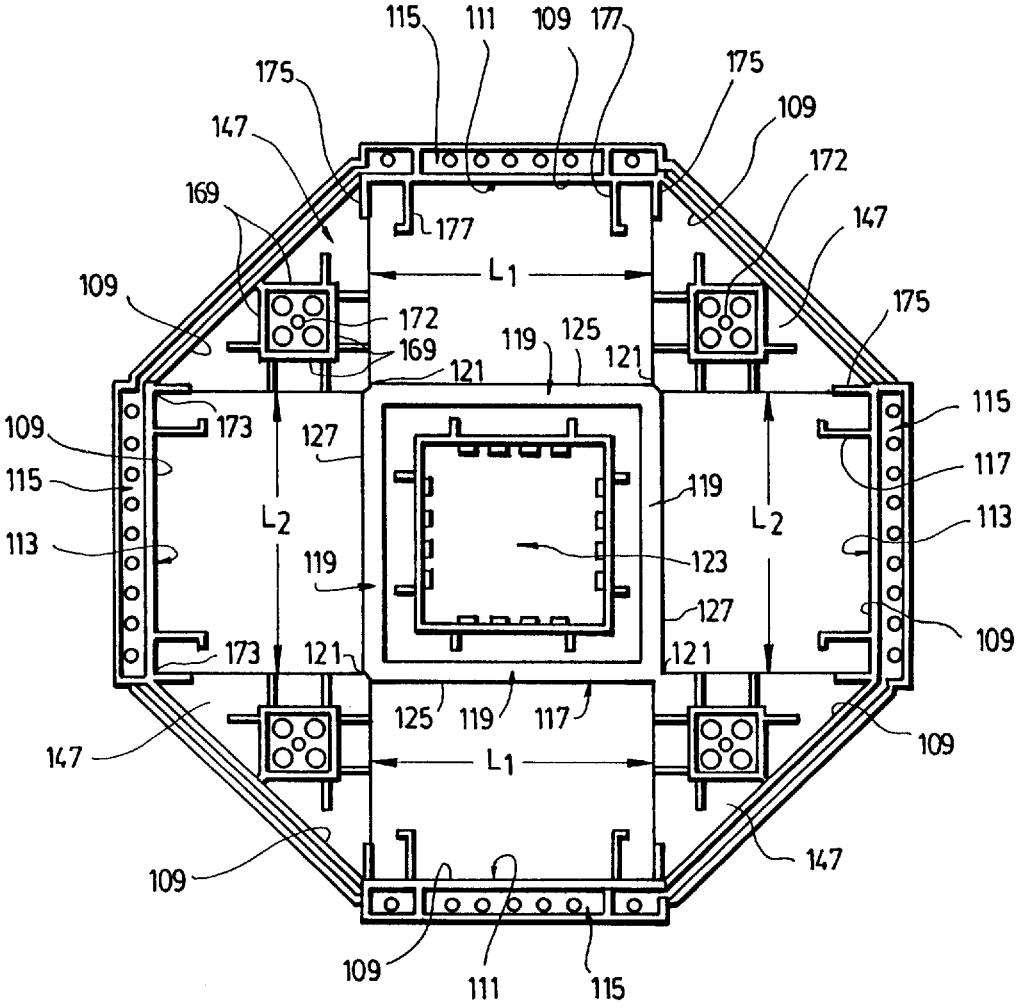
FIG. 4 is a bottom plan view of the toy construction piece shown in FIG. 3.

Preferably, one or both of the fifth 133 and sixth 135 pair of parallel sides has opposite ends 173, each of which are provided with a flange 175 on the inside surface 101. The flange extends perpendicularly to the parallel side from the flat surface 143 towards the bottom portion 105, as shown on FIGS. 1 and 4. Preferably also, each of the flanges 175 on the inside surface 101 are further provided with a secondary flange 177, located inwardly from the flange 175 and extending parallel to the corresponding flange 175 from the inside surface 101 towards the bottom portion 105.

The top portion 117 has a border 119, four corners 121 and a rectangular opening 123 therein, and lies in a plane parallel to the plane P at a perpendicular distance D from the plane P. The border 119 has a third 125 and fourth 127 pairs of parallel sides of length L3 and L4, respectively, the third pair 125 of parallel sides being parallel to the first pair 111 of parallel sides while the fourth pair 127 of parallel sides is parallel to the second pair 113 of parallel sides. The border 119 has a top surface 129 and an inner surface 131, and is provided with at least one row of outwardly projecting pegs 5 identical to those of the toy construction blocks 1, the longitudinal distance between every a pair of pegs 5 of the border being equal to d, and the border including a peg 5 at each corner 121. Preferably, the top portion 117 is coaxial to the bottom portion 105.

The border is preferably two-tiered, having an tipper portion 179 with four corners 180 and a lower portion 181 also with four corners 182. The upper portion 179 is provided with one row of outwardly projecting pegs 5 and a peg at each corner 180 and the lower portion 181 is provided with one row of outwardly projecting pegs 5 and a peg a each corner 182, where the longitudinal distance between every pair of pegs 5 of the upper portion 179 being is to d, the longitudinal distance between every pair of pegs 5 of the lower portion 181 is equal to d and the transverse distance between a peg 5 on the upper portion 179 and a peg on the lower portion 181 is equal to d. As shown on FIGS. 1, 2 and 3, the upper portion 179 has four sides each having ten pegs 5 and the lower portion 181 has four sides each having eight pegs 5.

The bottom wall portion 131 extends along the periphery of the bottom portion 105 and towards the top portion 117. The bottom wall portion 131 has a width W smaller than the distance D and has a fifth 133 and sixth 135 pairs of parallel sides of length L5 and L6, respectively, the fifth pair 133 of parallel sides being parallel to the first 111 and third 125 pairs of parallel sides while the sixth pair 135 of parallel sides is parallel to the second 113 and fourth 127 pairs of parallel sides.

It is preferable for the lengths L1, L3 and L5 to be equal, as well as for the lengths L2, L4 and L6 to be equal. In the preferred embodiment of the invention, shown on FIGS. 1, 2, 3 and 4, all of the lengths L1, L2, L3, L4, L5 and L6 are equal, and the bottom portion 105 is in the shape of an octogon.

The toy construction piece 100 also has first 137 and second 139 pairs of top wall portions. The first pair 137 of top wall portions has one top wall portion extending from one side of the fifth pair 133 of parallel sides to the corresponding side of the third pair 125 of parallel sides, The first pair 137 of top wall portions also has another top wall portion extending from the other side of the fifth pair 133 of parallel sides to the corresponding side of the third pair 125 of parallel sides. The second pair 139 of top wall portions has one top portion extending from one side of the sixth 135 pair of parallel sides to the corresponding side of the fourth pair 127 of parallel sides. The second pair 139 of top wall portions also has another top wall portion extending from the other side of the sixth pair 135 of parallel sides to the corresponding side of the fourth pair 127 of parallel sides. The first 137 and second 139 pairs of top wall portions form together a generally rectangular pyramidal shape as better shown on FIGS. 1 and 2 and define four generally dihedral recesses 141 between the four adjacent top wall portions respectively, each of the dihedral recesses 141 having a top 142 bounded by the top portion 117 and a bottom in the form of a flat surface 143 lying in a plane parallel to the plane P at a distance w from the plane P. Every flat surface 143 extends perpendicularly inwardly from the bottom wall portion 131 and has edges 145 and an inside surface 147.

The flat surfaces 143 are each provided with at least one row of at least one outwardly projecting peg 5 identical to those of the toy construction blocks 1, the longitudinal distance between adjacent pegs 5 of the row being equal to d, the transverse distance between adjacent pegs 5 being equal to d and the distance between every peg 5 adjacent to one of the edges 145 and the edge 145 being equal at least to ½d. As illustrated, the flat surface 143 are each provided with one row of six pegs near the edges 145, the number of pegs per row decreasing by one as one counts away from the edges 145.

Advantageously, the flat surfaces 143 are each further provided with an opening 149 having a width 151, a length 151, a depth 153 and a bottom 155 lying in a plane parallel to the plane P. The bottom 155 has an outside surface 157, an inside surface 159 and edges 161. The outside surface 157 is provided with at least one row of at least one outwardly projecting peg 5 identical to those of the toy construction blocks 1, where the longitudinal distance between a peg 5 and an adjacent peg is equal to d, the transverse distance between a peg 5 and an adjacent peg 5 is equal to d and the distance between every peg 5 adjacent one of the edges 161 and the edge 161 is equal to at least ½d. Preferably, as is illustrated, the outside surface 157 is provided with two rows of two outwardly projecting pegs 5.

The inside surface 159 of the bottom 155 of each of the openings 149 is provided with at least one row of at least one outwardly projecting peg 5 identical to those of the toy construction blocks 1, where the longitudinal distance between a peg 5 and an adjacent peg 5 is equal to d, the transverse distance between a peg 5 and an adjacent peg 5 is equal to d and the distance between every peg 5 adjacent one of the edges 161 and the edge 161 is equal to at least ½d. Preferably, as is illustrated, the inside surface 159 is provided with two rows of two outwardly projecting pegs 5.

The inside surface 159 is further bounded by four walls 169 projecting from the edges 161 in a direction opposite to the corresponding flat surface 143. As better shown on FIG. 1, at least two of the walls 169 are preferably each provided with a groove 171 extending towards the flat surface 143, in order to help remove a 2×2 toy construction block that would have been inserted onto the inside surface 159 of the openings 149. As well, each of the openings 149 is preferably further provided with a central hole 172, to help push out a 2×2 toy construction block that would have been inserted into the opening 149 on the outside surface 157.

(c) Means for interconnecting the toy construction piece with another toy construction piece In order to construct more complete structures, the toy construction piece 100 is provided with means for interconnecting one piece 100 with another identical piece 100. To that effect, the extensions 163 of the first 111 or second 113 pair of parallel sides are provided with a longitudinal recess 183. Preferably, the recess 183 is made in the extensions 163 of the first pair 111 of parallel sides. The recess 183 has opposite ends 185 and an opening on the bottom portion 105. Each of the opposite ends 185 is provided with a protrusion 189.

Figure 6:
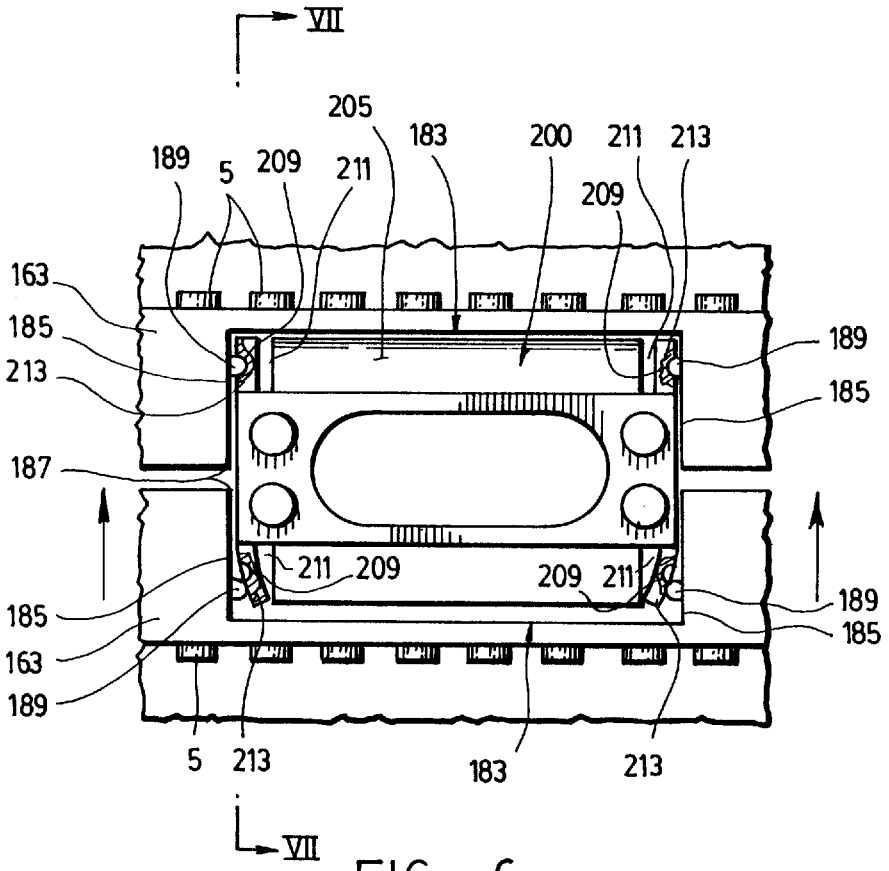
FIG. 6 is a top plan view showing the means to interconnect two identical toy construction pieces according to the invention.
Figure 7:
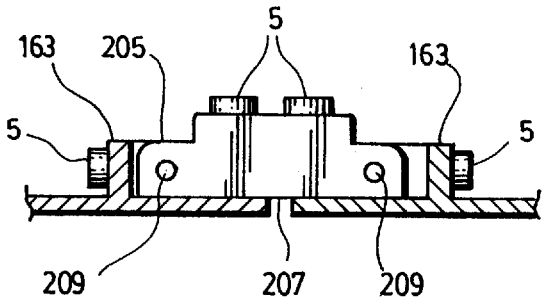
FIG. 7 is an end view of the hinge that is part of the means to interconnect two pieces shown in FIG. 6.
Figure 8:
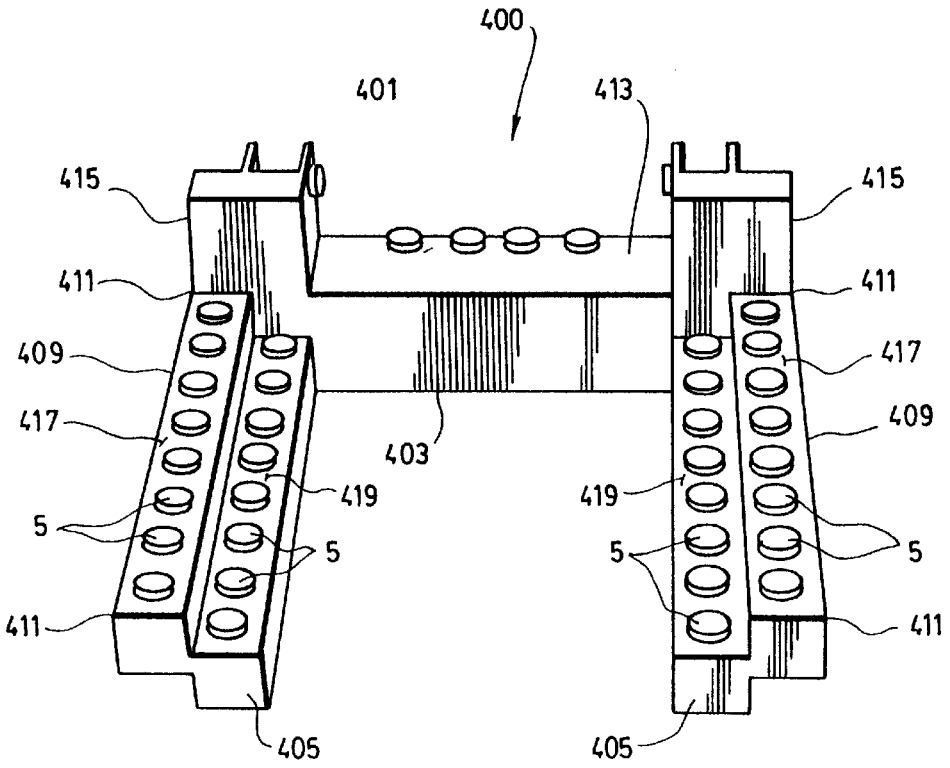
FIG. 8 is a front perspective view of a support member for use in the kit according to the invention.

The means for interconnecting also include a hinge member 200 which is symmetrical about a longitudinal axis LH. The hinge member 200 has a generally rectangular shape as shown on FIGS. 1, 2 and 6, two opposite ends 201, two opposite sides 203, a top surface 205 and a bottom surface 207. Each of the opposite ends 201 is provided with a cavity 209 near each of the opposite sides 203 and each of the opposite sides 203 is provided with a transverse groove 211 near each of the opposite ends 201 so as to define two winglets 213 near each of the opposite ends 201, the winglets 213 having a given resiliency as shown on FIG. 6. The hinge member 200 is sized in such a way that when one of the opposite sides 203 is inserted into the recess 183 of an extension 163, half of the hinge member 200 fits within the recess 183 and the cavity 209 corresponds to the protrusion 189 such that the hinge member 200 may be releasably interlocked in the recess 183 as shown on FIG. 6, which shows one half of the hinge member 200 inserted into the recess 183 and the other half of the hinge member about to be snapped into position. As can be readily imagined, the two toy construction pieces 100 may each pivot about an axis defined by the protrusions 189 and the cavities 209 on each side of the hinge member 200.

Preferably, the top surface 205 of the hinge member 200 is provided with at least one row of pegs 5 identical to those of tile toy construction blocks 1, the longitudinal distance between one peg and an adjacent peg of the row being equal to d, the transverse distance between one peg and an adjacent peg being equal to a multiple of d. As is illustrated, the top surface 205 is provided with two rows of two pegs, each row being located at a multiple of d from the respective opposite end 201. Also preferably, the bottom surface 207 is provided with means cooperating with the pegs 5 of a standard toy construction block 1 for releasably interlocking one of more of the standard toy construction blocks 1 on the bottom surface.

Hinge members 200 may thus be used to interconnect two identical toy construction pieces 100 together with their respective bottom portions 103 adjacent each other to form a full shell, of which FIG. 1 is an exploded view. Furthermore, a single hinge member 200 may be used to interconnect two identical toy construction pieces 100 side by side to form an open double half-shell, with one side of the first pair of parallel sides of one of the toy construction pieces 100 being located adjacent one side of the first pair of parallel sides of the other toy construction piece 100.

The full shell construction mentioned above may further be used to store standard blocks inside the full shell.

(d) Plate

In order to be able to interconnect various structures on the inside surface 101 of the toy construction piece 100, the kit may include one or more plates 300 which can be inserted inside the toy construction piece 100 as illustrated on FIG. 1.

Each plate 300 has a top surface 301, a bottom surface 303, a front end 305, a back end 307 and two opposite sides 309. The plate 300 is sized and shaped so as to be slidably inserted inside (or removed from) the toy construction piece 100 in a plane perpendicular to the plane P, such that the plate 300 rests on one flange 175 of one opposite ends 173 of the parallel side and on one flange 173 of one of the opposite ends 173 of the other parallel side.

As can be seen on FIG. 1, the front end 305 of the plate 300 tapers inwardly so as to fit snugly inside the toy construction piece 100. The plate 300 is preferably provided with at least one row of outwardly projecting pegs 5, the longitudinal distance between one peg 5 and an adjacent peg 5 being equal to d, the transverse distance between one peg 5 and an adjacent peg 5 being equal to d, the distance between a peg adjacent the back end 307 and the back end 307 being equal to at least ½d and the distance between a peg adjacent the front end 305 and the front end 305 being equal to at least ½d. Preferably, the bottom surface 303 is provided with means cooperating with at least one peg 5 of a standard block 1 for releasably interlocking at least one standard block on the bottom surface 303.

(e) Support Member

The kit according to the invention nay also include a support member 400. The support member 400 is generally U-shaped and has a top surface 401, a bottom surface 403, a front 405 and a back 407, two arms 409 each having two opposite ends 411 and a bridge 413 having two opposite ends 415. One of the arms 409 is connected to one of the opposite ends 415 of the bridge 413, the other arm 409 being connected to the other of the opposite ends 415 of the bridge 413. Each of the arms 409 is provided with at least one row of at least one outwardly projecting peg 5 on the top surface 401, the peg 5 being identical to those of the toy construction blocks 1, the longitudinal distance between one peg 5 and an adjacent peg 5 of the row being equal to d, the transverse distance between one peg 5 and an adjacent peg 5 being equal to d and the distance between one peg adjacent one of the opposite ends and the opposite end being equal to at least ½d.

Preferably, as illustrated on FIGS. 1, 2, 8 and 9, the arms are further provided with an outer portion 417 and an inner, lower portion 419, so that the outer portion 417 has one row of outwardly projecting pegs 5, and the inner, lower portion 419 has one row of outwardly projecting pegs 5, where the transverse distance between a peg 5 on the outer portion 417 and a peg on the inner, lower portion 419 is equal to d. Preferably, each of the outer portion and the inner, lower portion has one row of 8 pegs.

Figure 2:
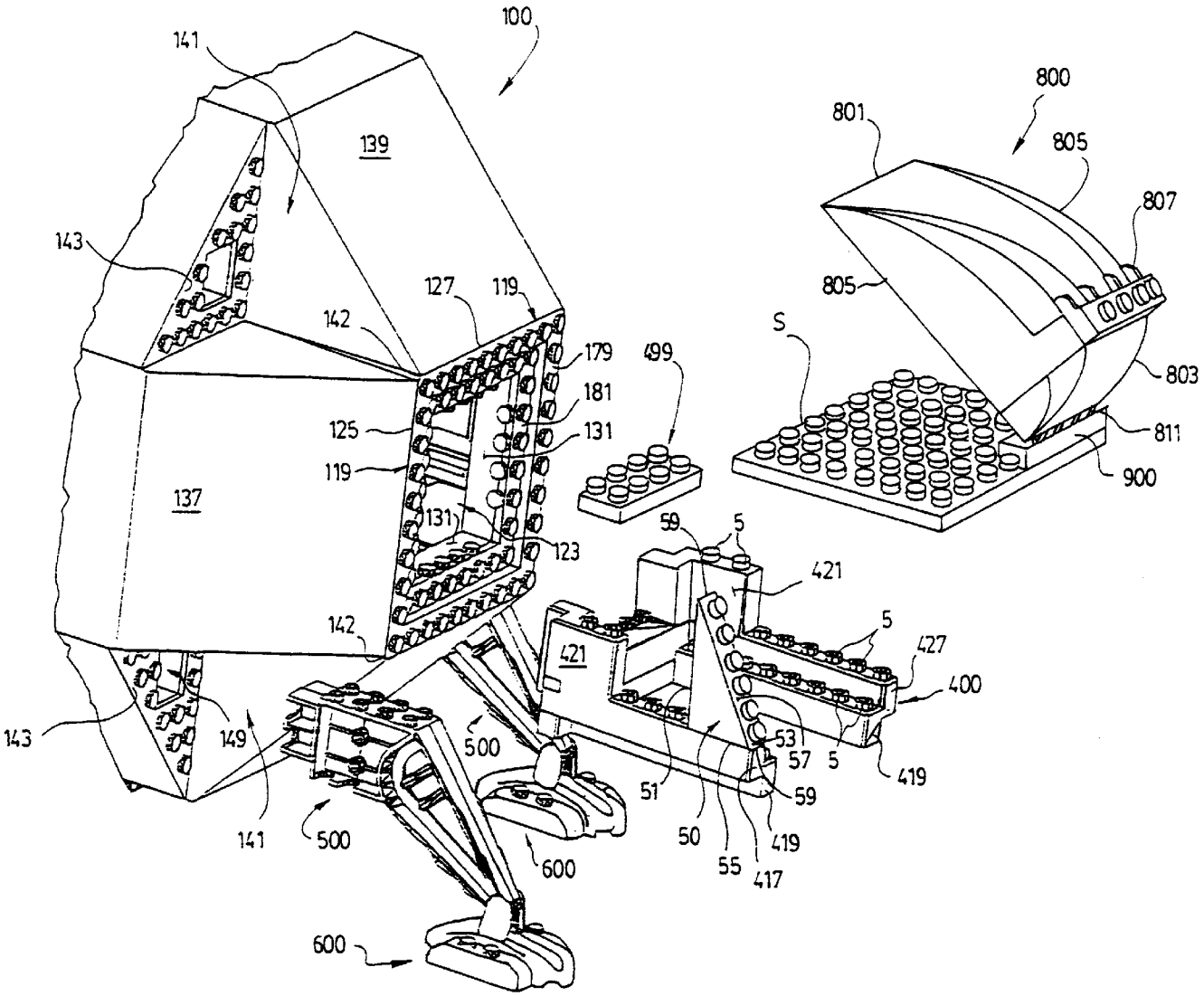
FIG. 2 is an exploded perspective view of a variation of the preferred embodiment of the kit shown in FIG. 1.

In a variation shown on FIGS. 1 and 2, the outer portion 417 of each of the arms 409 of the support member 400 may be provided with an upwardly extending wall 421 of given height near the bridge 413, the wall 421 including one row of two pegs on the top surface 401.

The bridge 413 is provided with at least one row of at least one outwardly projecting peg 5 on the top surface 401, the peg 5 being identical to those of the toy construction blocks 1, the longitudinal distance between one peg 5 and an adjacent peg 5 of the row being equal to d, the transverse distance between one peg 5 and an adjacent peg 5 being equal to d and the distance between one peg 5 adjacent one of the opposite ends and the opposite end being equal to at least ½d or a multiple thereof. Preferably, as shown on FIGS. 1, 2, 8 and 9, the bridge is provided with only one row of four pegs 5, centered in the middle of the bridge 413 and near the back 407. Thus, the support member 400 may be solidified by a toy construction plate 499 when releasably interlocked on the border 119 of the toy construction piece 100, as better shown on FIG. 2. The toy construction plate 499 is releasably interlocked half on the bridge 413 and half on the row of pegs 5 on the inner surface 131 of the opening 123.

The bottom surface 403 of the support member 400 is provided with means cooperating with the pegs 5 of the standard blocks 1 for releasably interlocking one or more of the standard blocks 1 on the bottom surface 403.

Figure 9:
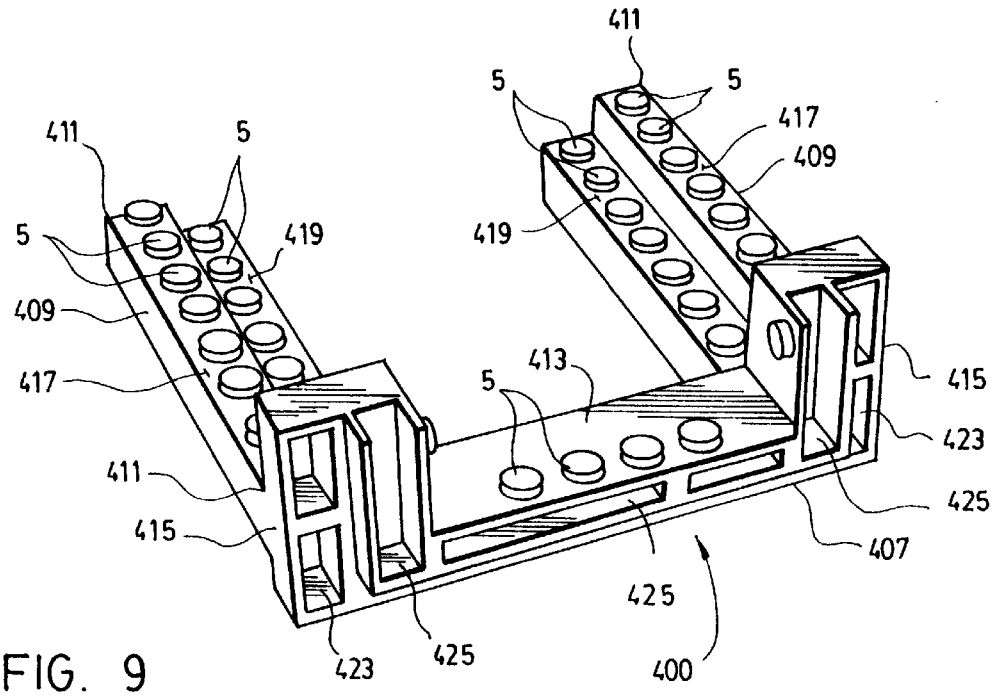
FIG. 9 is a rear perspective view of the support member shown in FIG. 8.

As better shown on FIG. 9, the back 407 has an outer portion 423 and an inner portion 425 extending rearwardly from the outer portion 423. The outer portion 423 of the back 407 is provided with means cooperating with the pegs 5 of the upper portion 179 of the border 119 for releasably interlocking the outer portion 423 on the upper portion 179 of the border 119 and the inner portion 425 of the back 407 is provided with means cooperating with the pegs 5 of the lower portion 181 of the border 119 for releasably interlocking the inner portion 425 on the lower portion 181 of the border 119.

(f) Leg

Figure 5:
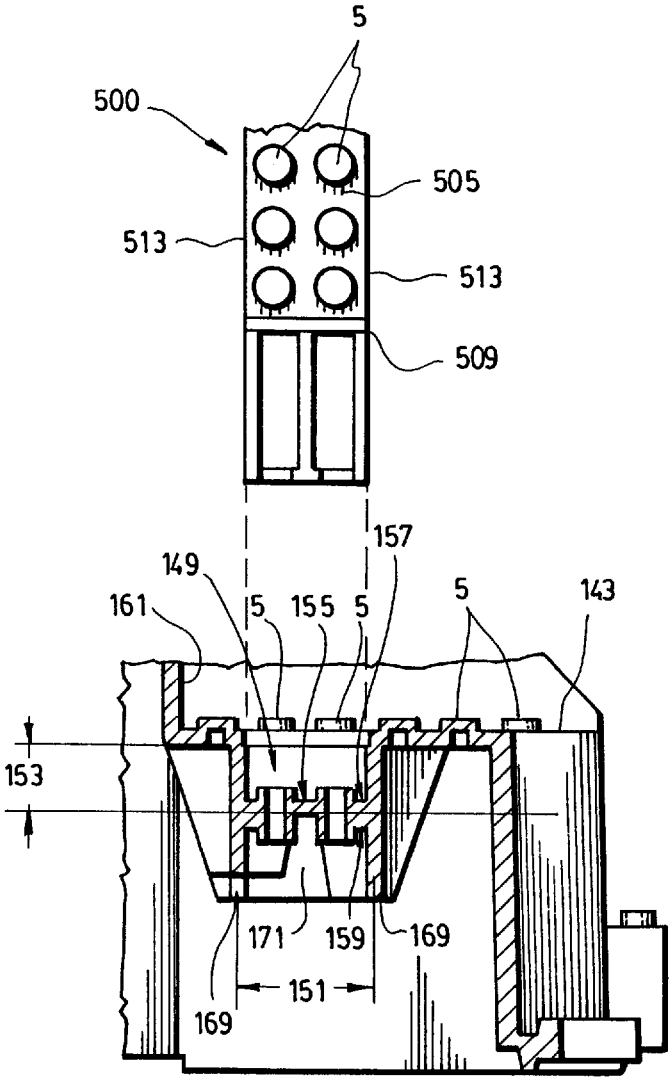
FIG. 5 is a cross-sectional view taken along line V—V of FIG. 3.
Figure 10:
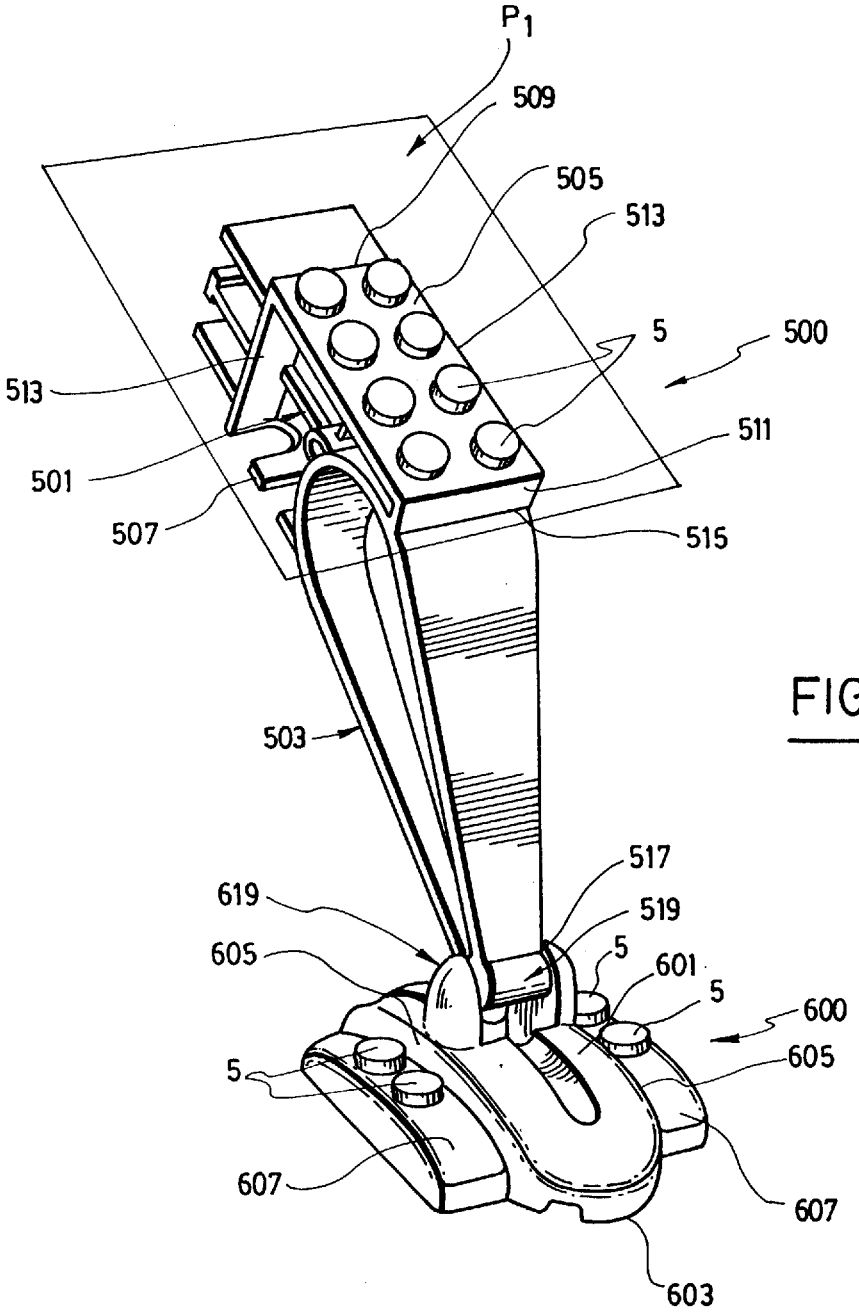
FIG. 10 is a front perspective view of a leg for use in the kit according to the invention.
Figure 11:
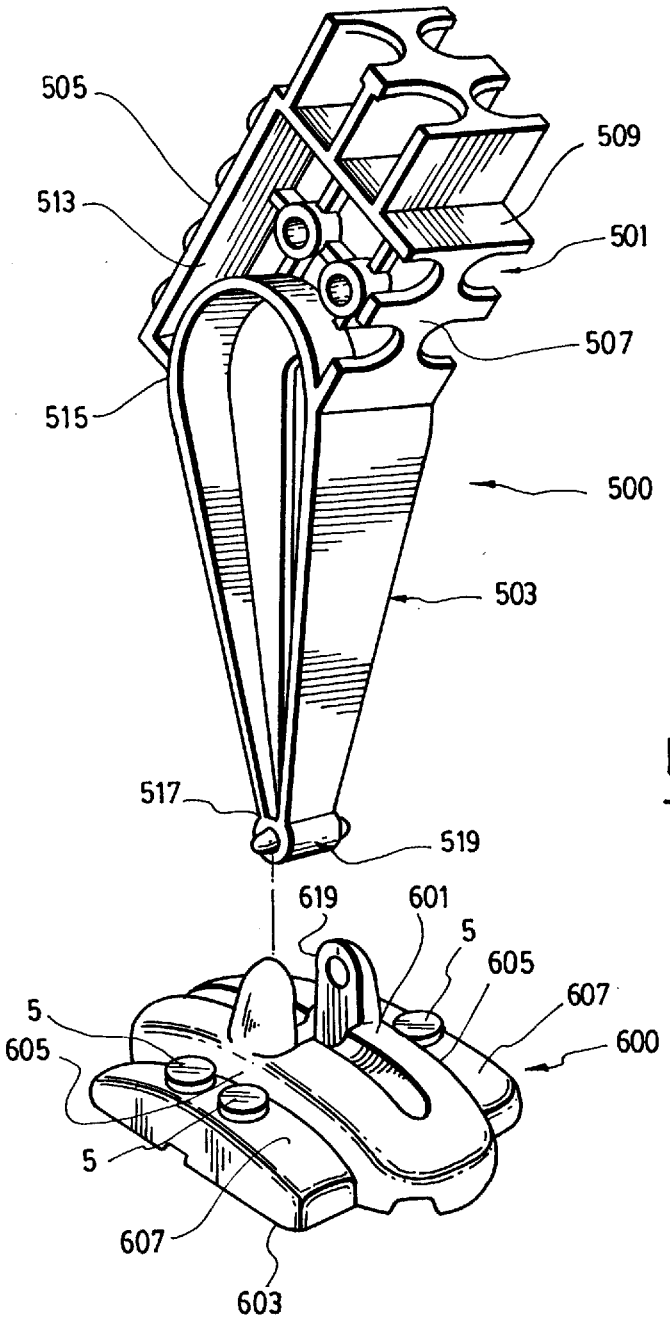
FIG. 11 is a rear perspective view of the leg shown in FIG. 10, showing in detail the attachment means for a foot.

The kit according to the invention may further include one or more leg 500 having a thigh portion 501 and a shank portion 503, shown generally on FIGS. 1 and 2, and detailed on FIGS. 5, 10 and 11.

Referring now to FIGS. 10 and 11, the thigh portion 501 has a top surface 505 lying in a plane P1, a bottom surface 507, a rear 509, a front 511 and two opposite sides 513. The rear 509 is provided with means cooperating with the pegs 5 of one of the openings 149 of the flat surface 143 for releasably interlocking the thigh portion 501 in the opening 147, as better shown on FIG. 5.

The shank portion 503 has first 515 and second 517 opposite ends, the first opposite end 515 of the shank portion 503 being connected to the front 511 of the thigh portion 501, the second opposite end 517 of the shank portion 503 being tapered, and lying in a plane at an angle from the plane P1. The second opposite end 517 of the shank portion 503 further comprises first attachment means 519.

Preferably, the top portion 505 of the leg 500 is provided with at least one row of at least one outwardly projecting peg 5, the longitudinal distance between one peg 5 and an adjacent peg 5 being equal to d, the transverse distance between a peg 5 and an adjacent peg 5 being equal to d, the distance between one peg 5 adjacent one of the opposite sides 513 and the opposite side 513 being equal to at least ½d, the distance between one peg 5 adjacent the rear 509 and the rear being equal to at least ½d and the distance between one peg 5 adjacent the front 511 and the front 511 being equal to at least ½d.

The bottom portion 507 is preferably provided with means cooperating with the pegs 5 of a standards block 1 for releasably interlocking one or more of the standard blocks 1 on the bottom portion 507 of the thigh portion 501.

Thus, the leg 500 may be inserted into the opening 147 as shown on FIGS. 1 and 2, that is oriented downwardly to hold the toy construction piece 100 in the manner shown. The leg may also be inserted on the inside surface 101 of the toy construction piece 100 on the pegs located on the inside surface 159 of the opening 147. The leg may further be inserted into an opening 147 so that the toy construction piece 100 has its bottom portion 105 oriented upwardly. It should be understood that any other configuration for releasably interlocking a leg 500 to the toy construction piece 100 may be possible.

(g) Foot

In order to stabilize the kit with a leg 500, the kit may also include at least one foot 600, shown on FIGS. 1, 2, 10 and 11. Referring now to FIGS. 10 and 11, the foot 600 has a top portion 601 which is preferably dome-shaped, a bottom portion 603 and two opposite sides 605. The top portion 601 comprising second attachment means 619 cooperating with the first attachment means 519 of the shank portion 503, the first 519 and second 619 attachment means being devised to allow the foot 600 to pivot with respect to the shank portion 503. As illustrated on FIGS. 10 and 11, the first 519 and second 619 attachment means may include a transverse pin on the shank portion 503 and two cavities on the foot 600 so that the foot 600 may pivot in one plane. However, the first 519 and second 619 attachment means may also include a ball and hole system making a universal joint-type of attachment.

The bottom portion 603 of the foot 600 is provided with means cooperating with the pegs 5 of the toy construction block 1 for releasably interlocking the standard block 5 onto the bottom portion 603 of the foot 600.

Preferably, the foot 600 further has a lateral extension 607 on each of the opposite sides 605, each of the lateral extensions 607 being provided with at least one row of outwardly projecting pegs 5 identical to those of the toy construction blocks 1, the longitudinal distance between one peg 5 and an adjacent peg 5 being equal to d, the transverse distance between a peg 5 and an adjacent peg 5 being equal to d. Preferably, however, the lateral extensions 607 include only one row of two pegs 5 as shown on FIGS. 1, 2, 10 and 11.

(h) Turret

In order to attach satellite dishes or other implements, the kit may include one or more turrets 700.

Each turret 700 is generally circular in shape and has a first 701 and second 703 rotating portions. The first rotating portion 701 has a top 705 and a bottom 707, the bottom 707 being provided with means cooperating with the pegs 5 of a standard block 1 for releasably interlocking the standard block 1 on the bottom 707 of the first rotating portion 701. Preferably, as shown on FIG. 12, the first rotating portion 701 also includes holes 709 in the bottom 707 so as to not interfere with the pegs 5 of a standard block 5 or, as shown, standard plate 10.

Figure 13:
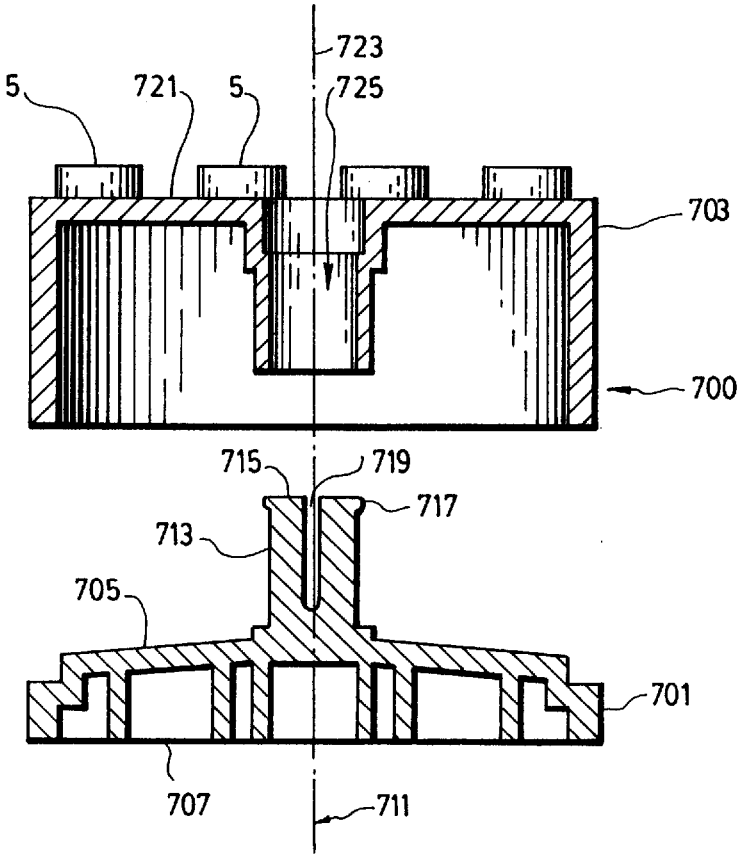
FIG. 13 is a detached cross-sectional view of the turret shown in FIG. 12.

The first rotating portion 701 has a central axis 711 and an inwardly tapering extension 713 projecting upwardly. The extension 713 has a top 715 and a flange 717 around the top 715 and is preferably longitudinally slitted 719, as shown on FIG. 13.

The second rotating portion 703 has a top surface 721, a rotation axis 723 coaxial with the central axis 711 and a hole 725 about the rotation axis 723. The top surface 721 is provided with at least one row of at least one outwardly projecting peg 5 identical to those of the standard construction block 1, the longitudinal distance between one peg 5 and an adjacent peg 5 being equal to d, the transverse distance between a peg 5 and an adjacent peg 5 being equal to d.

Figure 12:
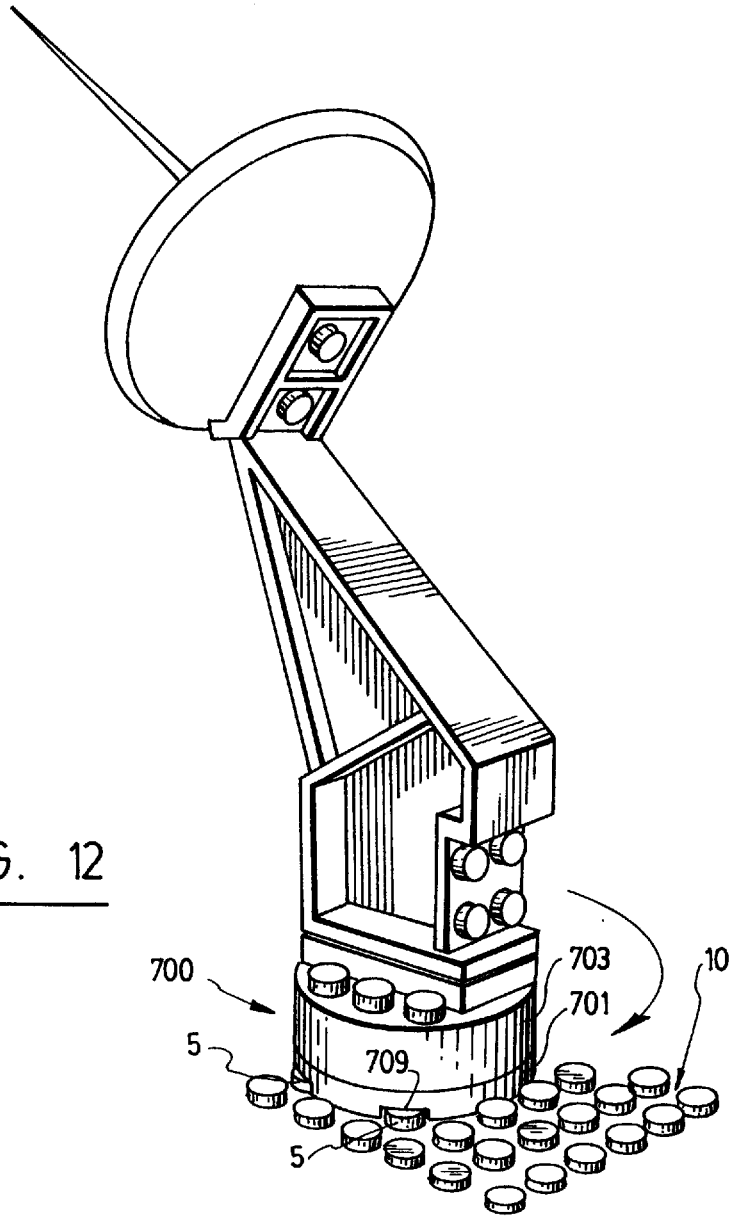
FIG. 12 is a perspective view of a turret, on which an accessory is mounted, for use in the kit according to the invention.
Figure 14:
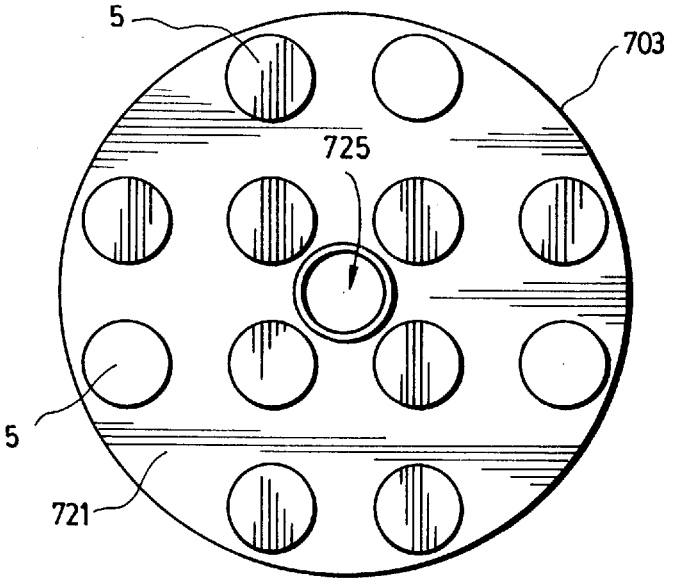
FIG. 14 is a top plan view of the turret shown in FIG. 12.

The extension 713 may be releasably interlocked into the hole 725 whereby the second rotating section 703 may rotate about the rotation axis 723 relative to the first rotating section 701, as shown on FIG. 12.

(i) Cockpit

In order to construct a realistic spaceship, the kit according to the invention may also include at least one cockpit 800 having a front 801, a back 803, two opposite sides 805, a top portion 807 and a bottom portion 809. The top portion 807 extends downwardly from the back 803 towards the front 801. Either the back 803 or the front 801 is provided with longitudinal tongues and grooves 811.

The cockpit of FIG. 1 has longitudinal tongues and grooves 811 at the front 801 and has the bottom portion 801 sized and shaped to be releasably interlocked onto the support member 400.

An alternative embodiment of the cockpit 800 is shown on FIG. 2. It has a similar structure where the top portion 807 of the cockpit 800 near the back 803 is provided with one row of four outwardly projecting pegs 5 identical to those of the toy construction blocks 1, the longitudinal distance between one peg 5 and an adjacent peg 5 being equal to d, the transverse distance between a peg 5 and an adjacent peg 5 being equal to d. The variation of FIG. 2 also shows the back 803 of the cockpit 800 being provided with longitudinal tongues and grooves 811.

(i) Cockpit Hinge

In order for the cockpit 800 to be opened and closed, the kit according to the invention may also include at least one cockpit hinge 900, shown on FIG. 1, having a top portion 901 and a bottom portion 903. The top portion 901 is provided with tongues and grooves 905 cooperating with the tongues and grooves 811 of the cockpit 800 for releasably interlocking the tongues and grooves 905 and 811 together, such that the cockpit 800 may pivot about the cockpit hinge 900.

The bottom portion 903 is provided with means cooperating with the pegs 5 of one or more of the construction blocks 1 for releasably interlocking the construction block 1, or a standard plate S as shown on FIG. 2, onto the bottom portion 903 of the cockpit hinge 900.

(k) Triangular Piece

It may be appropriate in some cases to releasably interlock standard blocks 1 at an angle. To that effect, the kit according to the invention may include a triangular piece 50, in the shape of a right-angle triangle, illustrated on FIG. 2. The triangular piece 50 has a back 51, a front 53, a bottom 55 and a top surface 57 having two opposite ends 59. The back 51 is preferably of the same height as the height of the wall 421 and the bottom 55 is provided with means cooperating with the pegs 5 of one or more toy construction blocks 1 for releasably interlocking the triangular piece 50 on top of the construction blocks 1.

The top surface 57 extends at an angle from the back 51 towards the front 53 and is provided with at least one row of at least one outwardly projecting peg 5 identical to those of the toy construction blocks 1, the longitudinal distance between one peg 5 and an adjacent peg 5 being equal to d, the transverse distance between a peg 5 and an adjacent peg 5 being equal to d, and the distance between one peg 5 adjacent one of the opposite ends 59 and the opposite end 59 being equal to ½d.

It should be readily apparent to a person skilled in the art of standard toy construction blocks that although no reference was made to particular distances, heights, lengths, widths or thicknesses, other than those specifically mentioned as forming part of a preferred embodiment of the invention, these quantities are to be chosen so as to enable the invention to be used with any other standard toy construction block.

Although the present invention has been explained hereinabove by way of a preferred embodiment thereof, it should be pointed out that any modifications to this preferred embodiment within the scope of the appended claims is not deemed to alter or change the nature and scope of the present invention.

What is claimed is:

1. A toy construction piece for use with standard toy construction blocks, each of said standard blocks having a given width and a given length and a top on which extends at least one row of at least one upwardly projecting peg, each of said at least one peg having a center, each of said standard blocks also having a bottom provided with means cooperating with said at least one peg of another standard block for releasably interlocking said standard block on top of said another standard block, wherein the width of each of said standard blocks is an integer multiple of a distance d and said length is another integer multiple of said distance d, and wherein said upwardly projecting peg is centered within a square of length d such that when said standard block has more than one row of more than one peg, the longitudinal and transverse distance between the centers of each pair of adjacent pegs is equal to d, said toy construction piece being in the form of a half-shell with an inside surface and an outside surface, said toy construction piece comprising:

a bottom portion lying in a plane P, said bottom portion having a periphery and including a bottom portion edge, said bottom portion edge having a first and second pair of parallel sides of length L1 and L2, respectively, said first pair of parallel sides being perpendicular to said second pair of parallel sides, said bottom portion being provided with means cooperating with the pegs of the standard blocks for releasably interlocking one or more of said standard blocks on said bottom portion of said toy construction piece;

a top portion having a border, four corners and a rectangular opening therein, said top portion lying in a plane parallel to the plane P at a perpendicular distance D from said plane P, said border having a third and fourth pairs of parallel sides of length L3 and L4, respectively, said third pair of parallel sides being parallel to the first pair of parallel sides while said fourth pair of parallel sides is parallel to the second pair of parallel sides, said border having a top surface and an inner surface, the border of said top portion being provided with at least one row of outwardly projecting pegs identical to those of the toy construction blocks, the longitudinal distance between every a pair of pegs of said border being equal to d, said border including a peg at each corner;

a bottom wall portion extending along the periphery of the bottom portion and towards said top portion, said bottom wall portion having a width W smaller than said distance D and having a fifth and sixth pairs of parallel sides of length L5 and L6, respectively, said fifth pair of parallel sides being parallel to the first and third pairs of parallel sides while said sixth pair of parallel sides is parallel to the second and fourth pairs of parallel sides;

a first and second pairs of top wall portions, wherein said first pair of top wall portions has one top wall portion extending from one side of the fifth pair of parallel sides to the corresponding side of the third pair of parallel sides, said first pair of top wall portions also having another top wall portion extending from the other side of the fifth pair of parallel sides to the corresponding side of the third pair of parallel sides, and where said second pair of top wall portions has one top portion extending from one side of the sixth pair of parallel sides to the corresponding side of the fourth pair of parallel sides, said second pair of top wall portions also having another top wall portion extending from the other side of the sixth pair of parallel sides to the corresponding side of the fourth pair of parallel sides, said first and second pairs of top wall portions forming together a generally rectangular pyramidal shape and defining four generally dihedral recesses between the four adjacent top wall portions respectively, each of said dihedral recesses having a top bounded by said top portion and a bottom in the form of a flat surface lying in a plane parallel to the plane P at a distance w from said plane P, said flat surface extending perpendicularly inwardly from said bottom wall portion and having edges and an inside surface;

wherein said flat surfaces are each provided with at least one row of at least one outwardly projecting peg identical to those of the toy construction blocks, the longitudinal distance between one peg and an adjacent peg of said at least one row being equal to d, the transverse distance between said one peg and said adjacent peg being equal to d and the distance between every peg adjacent to one of said edges and said one edge being equal at least to ½d.

2. A toy construction piece according to claim 1, wherein:

said first and second pair of parallel sides of the bottom portion are centered about a common axis perpendicular to said plane P; and said top portion is coaxial to said bottom portion.

3. A toy construction piece according to claim 2, wherein:

said length L5 is equal to said length L3 and is equal to said length L1; and said length L6 is equal to said length L4 and is equal to said length L2.

4. A toy construction piece according to claim 3, wherein:

said flat surfaces are each further provided with an opening having a width, a length, a depth and a bottom lying in a plane parallel to said plane P, said bottom having an outside surface, an inside surface and edges, said outside surface being provided with at least one row of at least one outwardly projecting peg identical to that of the toy construction blocks, the longitudinal distance between one peg and an adjacent peg of said at least one row being equal to d, the transverse distance between said one peg and said adjacent peg being equal to d and the distance between every peg adjacent to one of said edges and said one edge being equal to at least ½d.

5. A toy construction piece according to claim 4, wherein:

said first and second pairs of parallel sides are each provided with an extension on said outside surface, each of said extension having a top surface lying in a plane parallel to said plane P, said top surface having edges and being provided with at least one row of outwardly projecting pegs identical to those of the toy construction block, the longitudinal distance between one peg and an adjacent peg of said at least one row being equal to d, the transverse distance between said one peg and said adjacent peg being equal to d and the distance between every peg adjacent to one of said edges and said edge being equal to at least ½d.

6. A toy construction piece according to claim 5, wherein:

the inside surface of the bottom of each of said openings is provided with at least one row of at least one projecting peg identical to that of the toy construction blocks; and said inside surface is further bounded by four walls projecting from the edges in a direction opposite to the corresponding flat surface, where at least two of said four walls each are provided with a groove extending towards said flat surface.

7. A toy construction piece according to claim 6, wherein:

one of said fifth and sixth pair of parallel sides has opposite ends, each of said opposite ends being provided with a flange on said inside surface, said flange extending perpendicularly to said parallel sides from said flat surface towards said bottom portion.

8. A toy construction piece according to claim 7, wherein:

said toy construction piece is further provided with means for interconnecting said toy construction piece with another identical toy construction piece.

9. A toy construction piece according to claim 8, wherein said means for interconnecting include:

a longitudinal recess made in the extension of one of said first and second pair of parallel sides, said recess having opposite ends and an opening on said bottom portion, each of said opposite ends being provided with a protrusion; and a hinge member, said hinge member being symmetrical about a longitudinal axis and having a generally rectangular shape, two opposite ends, two opposite sides, a top surface and a bottom surface, wherein each of said opposite ends is provided with a cavity near each of said opposite sides, and each of said opposite sides is provided with a transverse groove near each of said opposite ends so as to define two winglets near each of said opposite ends, said hinge member being sized in such a way that when one of said opposite sides is inserted into said recess, half of said hinge member fits within said recess, said cavity corresponding to said protrusion such that said hinge member may be releasably interlocked in said recess.

10. A toy construction piece according to claim 9, wherein:

the top surface of the hinge member is provided with at least one row of pegs identical to those of the toy construction blocks, the longitudinal distance between one peg and an adjacent peg of said at least one row being equal to d, the transverse distance between said one peg and said adjacent peg being equal to d and said bottom surface being provided with means for releasably interlocking one or more of said standard blocks.

11. A toy construction piece according to claim 9, wherein the border of the top portion is two-tiered and has an upper portion having four corners and a lower portion having four corners, said upper portion having one row of outwardly projecting pegs and a peg at each corner, said lower portion having one row of outwardly projecting pegs and a peg at each corner, said upper portion having a width equal to d, said lower portion also having a width equal to d, the longitudinal distance between every pair of pegs of said upper portion being equal to d, the longitudinal distance between every pair of pegs of said lower portion being equal to d, the transverse distance between a peg on said upper portion and a peg on said lower portion being equal to d.

12. A toy construction piece according to claim 11, wherein:

said upper portion of said border has four sides and each of said four sides has ten pegs;

said lower portion of said border has four sides and each of said four sides has eight pegs.

13. A toy construction piece according to claim 12, wherein each of said extension of said first and second pairs of parallel sides has a length equal to ten times d and is equal to L1 and L2.

14. A toy construction piece according to claim 13, wherein each of said inside surface of said opening is provided with two rows of two projecting pegs each identical to those of the toy construction block, the longitudinal distance between every pair of pegs of said rows being equal to d, the transverse distance between a peg on one row and a peg on the other row being equal to d and the distance between a peg adjacent to one wall of said four walls and said wall being equal to at least ½d.

15. A kit for assembling a toy comprising:

(a) standard toy construction blocks, each of said standard blocks having a given width and a given length and a top on which extends at least one row of at least one upwardly projecting peg, each of said at least one peg having a center, each of said standard blocks also having a bottom provided with means cooperating with said at least one peg of another standard block for releasably interlocking said standard block on top of said another standard block, wherein the width of each of said standard blocks is an integer multiple of a distance d and said length is another integer multiple of said distance d, and wherein said upwardly projecting peg is centered within a square of length d such that when said standard block has more than one row of more than one peg, the longitudinal and transverse distance between the centers of each pair of adjacent pegs is equal to d, and (b) at least one toy construction piece, said toy construction piece being in the form of a half-shell with an inside surface and an outside surface, said toy construction piece comprising:

a bottom portion lying in a plane P, said bottom portion having a periphery and including a bottom portion edge, said bottom portion edge having a first and second pair of parallel sides of length L1 and L2, respectively, said first pair of parallel sides being perpendicular to said second pair of parallel sides, said bottom portion being provided with means cooperating with the pegs of the standard blocks for releasably interlocking one or more of said standard blocks on said bottom portion of said toy construction piece;

a top portion having a border, four corners and a rectangular opening therein, said top portion lying in a plane parallel to the plane P at a perpendicular distance D from said plane P, said border having a third and fourth pairs of parallel sides of length L3 and L4, respectively, said third pair of parallel sides being parallel to the first pair of parallel sides while said fourth pair of parallel sides is parallel to the second pair of parallel sides, said border having a top surface and an inner surface, the border of said top portion being provided with at least one row of outwardly projecting pegs identical to those of the toy construction blocks, the longitudinal distance between every a pair of pegs of said border being equal to d, said border including a peg at each corner;

a bottom wall portion extending along the periphery of the bottom portion and towards said top portion, said bottom wall portion having a width W smaller than said distance D and having a fifth and sixth pairs of parallel sides of length L5 and L6, respectively, said fifth pair of parallel sides being parallel to the first and third pairs of parallel sides while said sixth pair of parallel sides is parallel to the second and fourth pairs of parallel sides;

a first and second pairs of top wall portions, wherein said first pair of top wall portions has one top wall portion extending from one side of the fifth pair of parallel sides to the corresponding side of the third pair of parallel sides, said first pair of top wall portions also having another top wall portion extending from the other side of the fifth pair of parallel sides to the corresponding side of the third pair of parallel sides, and where said second pair of top wall portions has one top portion extending from one side of the sixth pair of parallel sides to the corresponding side of the fourth pair of parallel sides, said second pair of top wall portions also having another top wall portion extending from the other side of the sixth pair of parallel sides to the corresponding side of the fourth pair of parallel sides, said first and second pairs of top wall portions forming together a generally rectangular pyramidal shape and defining four generally dihedral recesses between the four adjacent top wall portions respectively, each of said dihedral recesses having a top bounded by said top portion and a bottom in the form of a flat surface lying in a plane parallel to the plane P at a distance w from said plane P, said flat surface extending perpendicularly inwardly from said bottom wall portion and having edges and an inside surface;

wherein said flat surfaces are each provided with at least one row of at least one outwardly projecting peg identical to those of the toy construction blocks, the longitudinal distance between one peg and an adjacent peg of said at least one row being equal to d, the transverse distance between said one peg and said adjacent peg being equal to d and the distance between every peg adjacent to one of said edges and said one edge being equal at least to ½d.

16. A kit according to claim 15, wherein:

said first and second pair of parallel sides of the bottom portion are centered about a common axis perpendicular to said plane P;

said top portion is coaxial to said bottom portion;

said flat surfaces are each further provided with an opening having a width, a length, a depth and a bottom lying in a plane parallel to said plane P, said bottom having an outside surface, an inside surface and edges, said outside surface being provided with at least one row of at least one outwardly projecting peg identical to that of the toy construction block, the longitudinal distance between one peg and an adjacent peg of said at least one row being equal to d, the transverse distance between said one peg and said adjacent peg being equal to d and the distance between every peg adjacent to one of said edges and one of said edges being equal to at least ½d;

said first and second pairs of parallel sides are each provided with an extension on said outside surface, each of said extension having and a top surface lying in a plane parallel to said plane P;

the inside surface of the bottom of each of said openings is provided with at least one row of at least one projecting peg identical to that of the toy construction blocks;

said inside surface is further bounded by four walls projecting from the edges in a direction opposite to the corresponding flat surface, where at least two of said four walls each are provided with a groove extending towards said flat surface.

17. A kit according to claim 16, further comprising:

(c) means for interconnecting said toy construction piece with another identical toy construction piece, wherein said means for interconnecting include:

a longitudinal recess made in the extension one of said first and second pair of parallel sides, said recess having opposite ends and an opening on said bottom portion, each of said opposite ends being provided with a protrusion; and a hinge member, said hinge member being symmetrical about a longitudinal axis and having a generally rectangular shape, two opposite ends, two opposite sides, a top surface and a bottom surface, wherein each of said opposite ends is provided with a cavity near each of said opposite sides and each of said opposite sides is provided with a transverse groove near each of said opposite ends so as to define two winglets near each of said opposite ends, said hinge member being sized in such a way that when one of said opposite sides is inserted into said recess, half of said hinge member fits within said recess, said cavity corresponding to said protrusion such that said hinge member may be releasably interlocked in said recess.

18. A kit according to claim 17, wherein:

the top surface of said hinge member is provided with at least one row of outwardly projecting pegs identical to those of the toy construction blocks, the longitudinal distance between one peg and an adjacent peg of said at least one row being equal to d, the transverse distance between said one peg and said adjacent peg being equal to d; and said bottom surface is provided with means for releasably interlocking one or more of said standard blocks.

19. A kit according to claim 16, wherein:

at least one of said fifth or sixth pair of parallel sides has opposite ends, each of said opposite ends being provided with a flange on said inside surface, said flange extending perpendicularly to said parallel sides from said flat surface towards said bottom portion; and said kit further comprises (d) a plate, said plate having a top surface, a bottom surface, a front end, a back end and two opposite sides, said plate being sized and shaped so as to be inserted inside said toy construction piece in a plane perpendicular to said plane P, such that said plate rests on one flange of one of said opposite ends of said first side and on one flange of one of said opposite ends of said second side.

20. A kit according to claim 19, wherein said plate is provided with at least one row of outwardly projecting pegs identical to those of the toy construction blocks, the longitudinal distance between one peg and an adjacent peg of said at least one row being equal to d, the transverse distance between said one peg and said adjacent peg being equal to d, the distance between a peg adjacent said front end and said front end being equal to at least ½d, the distance between a peg adjacent said back end and said back end being equal to at least ½d and the distance between a peg adjacent one of said opposite sides and said opposite side being equal to at least ½d.

21. A kit according to claim 16, wherein:

the border of the top portion is two-tiered and has an upper portion having four corners and a lower portion having four corners, said upper portion having one row of outwardly projecting pegs and a peg at each corner, said lower portion having one row of outwardly projecting pegs and a peg at each corner, said upper portion having a width equal to d, said lower portion also having a width equal to d, the longitudinal distance between every pair of pegs of said upper portion being equal to d, the longitudinal distance between every pair of pegs of said lower portion being equal to d, the transverse distance between a peg on said upper portion and a peg on said lower portion being equal to d; and said kit further comprises:

(e) at least one support member, said at least one support member being generally U-shaped and having a top surface, a bottom surface, a front and a back, two arms each having two opposite ends and a bridge having two opposite ends, one of said two arms being connected to one of said opposite ends of said bridge, the other of said arms being connected to the other of said opposite ends of said bridge, where each of said arms is provided with at least one row of at least one outwardly projecting peg on said top surface, said peg being identical to those of the toy construction blocks, the longitudinal distance between one peg and an adjacent peg of said at least one row being equal to d, the transverse distance between said one peg and said adjacent peg being equal to d and the distance between one peg adjacent one of said opposite ends and said opposite end being equal to at least ½d;

said bridge is provided with at least one row of at least one outwardly projecting peg on said top surface, said peg being identical to those of the toy construction blocks, the longitudinal distance between one peg and an adjacent peg of said at least one row being equal to d, the transverse distance between said one peg and said adjacent peg being equal to d and the distance between one peg adjacent one of said opposite ends and said opposite end being equal to at least ½d;

said bottom surface is provided with means cooperating with the pegs of the standard blocks for releasably interlocking one or more of said standard blocks on said bottom surface of said support member; and said back has an outer portion and an inner portion, said inner portion extending rearwardly from said outer portion, said outer portion of said back being provided with means cooperating with the pegs of the upper portion of said border for releasably interlocking said outer portion on said upper portion of said border and said inner portion of said back being provided with means cooperating with the pegs of the lower portion of said border for releasably interlocking said inner portion on said lower portion of said border.

22. A kit according to claim 21, wherein:

each of said arms further have an outer portion and an inner, lower portion, said outer portion being provided with one row of outwardly projecting pegs, said inner, lower portion being provided with one row of outwardly projecting pegs, where the transverse distance between a peg on said outer portion and a peg on said inner, lower portion is equal to d.

23. A kit according to claim 22 further comprising:

(i) at least one cockpit having a front, a back, two opposite sides, a top portion and a bottom portion, said top portion extending downwardly from said back towards said front, one of said back and front being provided with longitudinal tongues and grooves; and (j) at least one cockpit hinge having a top portion and a bottom portion, said top portion being provided with tongues and grooves cooperating with said tongues and grooves of said cockpit for releasably interlocking said tongues and grooves together, such that said cockpit may pivot about said cockpit hinge, said bottom portion being provided with means cooperating with the pegs of one or more of the construction blocks for releasably interlocking the construction block onto the bottom portion of the cockpit hinge.

24. A kit according to claim 23, wherein the top portion of said cockpit near said back is provided with at least one row of at least one outwardly projecting peg identical to those of the toy construction blocks, the longitudinal distance between one peg and an adjacent peg being equal to d, the transverse distance between said peg and said adjacent peg being equal to d.

25. A kit according to claim 22, wherein the outer portion of each of said arms of said support member is provided with an upwardly extending wall near said bridge, said wall having a given height; and said kit further comprises:

(k) a triangular piece, said triangular piece being in the shape of a right-angle triangle, said triangular piece having a back, a front, a bottom and a top surface having two opposite ends, said back being of the same height as said height of said wall, said bottom being provided with means cooperating with the pegs of one or more toy construction blocks for releasably interlocking said triangular piece on top of the construction blocks, said top surface extending at an angle from said back to said front and being provided with at least one row of at least one outwardly projecting peg identical to those of the toy construction blocks, the longitudinal distance between one peg and an adjacent peg being equal to d, the transverse distance between said peg and said adjacent peg being equal to d, and the distance between one peg adjacent one of said opposite ends and said opposite end being equal to ½d.

26. A kit according to claim 16, wherein:

each of said inside surface of said opening is provided with two rows of two projecting pegs each identical to those of the toy construction block, the longitudinal distance between every pair of pegs of said rows being equal to d, the transverse distance between a peg on one row and a peg on the other row being equal to d and the distance between a peg adjacent to one wall of said four walls and said wall being equal to at least ½d; and said kit further comprises:

(f) at least one leg, said at least one leg having a thigh portion and a shank portion, said thigh portion having a top surface lying in a plane P1, a bottom surface, a rear, a front and two opposite sides, said rear being provided with means cooperating with said pegs of one of said opening of said flat surface for releasably interlocking said thigh portion on said opening;

said shank portion having a first and second opposite ends, said first opposite end of said shank portion being connected to said front of said thigh portion, said second opposite end of said shank portion being tapered, said shank portion lying in a plane at an angle from said plane P1, said second opposite end of said shank portion further comprising first attachment means.

27. A kit according to claim 26, wherein:

said top portion of said leg is provided with at least one row of at least one outwardly projecting peg, the longitudinal distance between one peg and an adjacent peg being equal to d, the transverse distance between said peg and said adjacent peg being equal to d, the distance between one peg adjacent one of said opposite sides and said opposite side being equal to ½d, the distance between one peg adjacent said rear and said rear being equal to ½d and the distance between one peg adjacent said front and said front being equal to ½d;

said bottom portion is provided with means cooperating with the pegs of a standards blocks for releasably interlocking one or more of said standard blocks on said bottom portion of said thigh portion.

28. A kit according to claim 26 further comprising:

(g) at least one foot, said at least one foot having a top portion, a bottom portion and two opposite sides, said top portion comprising second attachment means cooperating with the first attachment means of the shank portion, said first and second attachment means being devised to allow said foot to pivot with respect to said shank portion, and said bottom portion is provided with means cooperating with the pegs of the toy construction block for releasably interlocking the standard block onto said bottom portion of said foot.

29. A kit according to claim 28, wherein said foot further has a lateral extension on each of said opposite sides, each of said lateral extension being provided with at least one row of outwardly projecting pegs identical to those of the toy construction blocks, the longitudinal distance between one peg and an adjacent peg being equal to d, the transverse distance between said peg and said adjacent peg being equal to d.

30. A kit according to claim 16, wherein said kit further comprises (h) at least one turret, said at least one turret being generally circular in shape and having a first and second rotating portions, said first rotating portion having a top and a bottom, said bottom being provided with means cooperating with the pegs of a standard block for releasably interlocking the standard block on the bottom of the first rotating portion, the first rotating portion having a central axis and an inwardly tapering extension projecting upwardly, said extension having a top and a flange around said top;

said second rotating portion having a top surface, a rotation axis coaxial with said central axis and a hole about said rotation axis, said top surface being provided with at least one row of at least one outwardly projecting peg identical to those of the standard construction block, the longitudinal distance between one peg and an adjacent peg being equal to d, the transverse distance between said peg and said adjacent peg being equal to d, wherein said extension may be releasably interlocked into said hole whereby said second rotating section may rotate about said rotation axis relative to said first rotating section.

31. A kit according to claim 17, wherein:

said length L5 is equal to said length L3 and is equal to said length L1;

said length L6 is equal to said length L4 and is equal to said length L2;

the top surface of said extensions of said first pair of parallel sides has a length equal to ten times d and is equal to L1 and L2, said top surface also having edges and being provided with at least one row of outwardly projecting pegs identical to those of the toy construction blocks, the longitudinal distance between every pair of pegs of said top surface being equal to d, the transverse distance between said one peg and said adjacent peg being equal to d and the distance between a peg adjacent one of said edges and said edge being equal to at least ½d;

said upper portion of said border has four sides and each of said four sides has ten pegs;

said lower portion of said border has four sides and each of said four sides has eight pegs.

32. A kit according to claim 19, wherein:

said length L5 is equal to said length L3 and is equal to said length L1;

said length L6 is equal to said length L4 and is equal to said length L2;

the top surface of said extensions of said first pair of parallel sides has a length equal to ten times d and is equal to L1 and L2, said top surface also having edges and being provided with at least one row of outwardly projecting pegs identical to those of the toy construction blocks, the longitudinal distance between every pair of pegs of said top surface being equal to d, the transverse distance between said one peg and said adjacent peg being equal to d and the distance between a peg adjacent one of said edges and said edge being equal to at least ½d;

said upper portion of said border has four sides and each of said four sides has ten pegs; and said lower portion of said border has four sides and each of said four sides has eight pegs.

33. A kit according to claim 22, wherein:

said length L5 is equal to said length L3 and is equal to said length L1;

said length L6 is equal to said length L4 and is equal to said length L2;

the top surface of said extensions of said first pair of parallel sides has a length equal to ten times d and is equal to L1 and L2, said top surface also having edges and being provided with at least one row of outwardly projecting pegs identical to those of the toy construction blocks, the longitudinal distance between every pair of pegs of said top surface being equal to d, the transverse distance between said one peg and said adjacent peg being equal to d and the distance between a peg adjacent one of said edges and said edge being equal to at least ½d;

said upper portion of said border has four sides and each of said four sides has ten pegs;

said lower portion of said border has four sides and each of said four sides has eight pegs; and the inner surface of said border is provided with at least one row of outwardly projecting pegs identical to those of the toy construction blocks, the longitudinal distance between one peg and an adjacent peg being equal to d and the transverse distance between said peg and said adjacent peg being equal to d.

34. A kit according to claim 23, wherein:

said length L5 is equal to said length L3 and is equal to said length L1;

said length L6 is equal to said length L4 and is equal to said length L2;

the top surface of said extensions of said first pair of parallel sides has a length equal to ten times d and is equal to L1 and L2, said top surface also having edges and being provided with at least one row of outwardly projecting pegs identical to those of the toy construction blocks, the longitudinal distance between every pair of pegs of said top surface being equal to d, the transverse distance between said one peg and said adjacent peg being equal to d and the distance between a peg adjacent one of said edges and said edge being equal to at least ½d;

said upper portion of said border has four sides and each of said four sides has ten pegs; and said lower portion of said border has four sides and each of said four sides has eight pegs.

35. A kit according to claim 28, wherein:

said length L5 is equal to said length L3 and is equal to said length L1;

said length L6 is equal to said length L4 and is equal to said length L2;

the top surface of said extensions of said first pair of parallel sides has a length equal to ten times d and is equal to L1 and L2, said top surface also having edges and being provided with at least one row of outwardly projecting pegs identical to those of the toy construction blocks, the longitudinal distance between every pair of pegs of said top surface being equal to d, the transverse distance between said one peg and said adjacent peg being equal to d and the distance between a peg adjacent one of said edges and said edge being equal to at least ½d;

said upper portion of said border has four sides and each of said four sides has ten pegs; and said lower portion of said border has four sides and each of said four sides has eight pegs.

36. A kit according to claim 30, wherein:

said length L5 is equal to said length L3 and is equal to said length L1;

said length L6 is equal to said length L4 and is equal to said length L2;

the top surface of said extensions of said first pair of parallel sides has a length equal to ten times d and is equal to L1 and L2, said top surface also having edges and being provided with at least one row of outwardly projecting pegs identical to those of the toy construction blocks, the longitudinal distance between every pair of pegs of said top surface being equal to d, the transverse distance between said one peg and said adjacent peg being equal to d and the distance between a peg adjacent one of said edges and said edge being equal to at least ½d;

said upper portion of said border has four sides and each of said four sides has ten pegs; and said lower portion of said border has four sides and each of said four sides has eight pegs.

* * * * *